US010712693B2

(12) United States Patent
Cho et al.

(10) Patent No.: US 10,712,693 B2
(45) Date of Patent: Jul. 14, 2020

(54) IMAGE FORMING APPARATUS WITH PROTECTION OF FIXING UNIT WHEN MAIN ASSEMBLY IS OPENED

(71) Applicant: CANON KABUSHIKI KAISHA, Tokyo (JP)

(72) Inventors: Shinta Cho, Kawasaki (JP); Atsushi Oguni, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/353,752

(22) Filed: Mar. 14, 2019

(65) Prior Publication Data

US 2019/0286023 A1 Sep. 19, 2019

(30) Foreign Application Priority Data

Mar. 15, 2018 (JP) ..... 2018-047814

(51) Int. Cl.

| | |
|---|---|
| ***G03G 15/20*** | (2006.01) |
| ***G03G 15/00*** | (2006.01) |
| ***G03G 21/16*** | (2006.01) |

(52) U.S. Cl.

CPC ..... *G03G 15/2028* (2013.01); *G03G 15/2017* (2013.01); *G03G 15/5004* (2013.01); *G03G 15/6511* (2013.01); *G03G 21/1633* (2013.01)

(58) Field of Classification Search

CPC ..... G03G 15/2028; G03G 15/2017; G03G 15/2035

See application file for complete search history.

(56) References Cited

FOREIGN PATENT DOCUMENTS

| | | |
|---|---|---|
| JP | 2003-140480 A | 5/2003 |
| JP | 2012-047970 A | 3/2012 |

*Primary Examiner* — David M. Gray
*Assistant Examiner* — Andrew V Do
(74) *Attorney, Agent, or Firm* — Venable LLP

(57) ABSTRACT

An image forming apparatus includes a door; an image forming portion to form an image on a sheet; an image fixing portion including a heater, a nip, an electric energy supply connector for supplying electric energy to the heater, and a shutter for opening and closing an entrance of the fixing portion which leads to the nip; and a link connecting the door and shutter with each other to move the shutter in interrelation with movement of the door. When the door is opened, the link moves in a direction crossing with a surface of the nip to cause the shutter to move from an entrance opening position to an entrance closing position. When the shutter is in the closing position, substantially an entirety of the electric energy supply connector is covered by the link, as viewed from an upstream side relative to a sheet feeding direction in the nip.

6 Claims, 20 Drawing Sheets

COMPARATIVE EXAMPLE

COMPARATIVE EXAMPLE

COMPARATIVE EXAMPLE

COMPARATIVE EXAMPLE

IMAGE FORMING APPARATUS WITH PROTECTION OF FIXING UNIT WHEN MAIN ASSEMBLY IS OPENED

FIELD OF THE INVENTION AND RELATED ART

The present invention relates to an image forming apparatus such as an electrophotographic copying machine, an electrophotographic printer, etc.

An image forming apparatus such as an electrophotographic copying machine, an electrophotographic printer, etc., is provided with a cover which can be opened to expose the interior of the main assembly of the image forming apparatus, in order to make it easier to maintain an image forming apparatus, for example, to replace a cartridge which is removably installable in the main assembly of the image forming apparatus, and also, to make it easier to deal with paper jam or the like. Opening the cover makes it possible for a user to insert his or her hand(s) into the main assembly. Thus, various measures are taken to prevent a user from coming into contact with a fixing device in the main assembly.

A fixing device has: a power supply connector; a heater which generates heat as it is supplied with electric power through the power supply connector; a fixing member such as a cylindrical film a roller, or the like, which is heated by the heater; and a pressing member such as a cylindrical roller and a cylindrical belt which forms a nip with the fixing member. A sheet of recording medium on which an unfixed toner image is borne is heated in the nip while it is conveyed through the nip remaining pinched between the fixing member and pressing member. As a result, the toner image becomes fixed to the sheet of recording medium.

There is disclosed in Japanese Laid-open Patent Application No. 2003-140480, an image forming apparatus, the main assembly of which is provided with a shutter which can be opened or closed, and covers the fixing member of the fixing portion by being moved by the opening movement of the cover. It has been desired to devise this type of image forming apparatus, without significantly increasing the image forming apparatus in cost and size, so that the power supply connector of the fixing portion becomes protected by the result of the opening movement of the cover of the apparatus main assembly.

Thus, the primary object of the present invention is to provide an image forming apparatus which is structured so that the power supplying portion of the fixing portion becomes protected as the pivotally movable cover of the main assembly of the apparatus is pivotally opened, and which yet is only minimally higher in cost and size than any conventional image forming apparatus of the similar type.

SUMMARY OF THE INVENTION

According to an aspect of the present invention, there is provided an image forming apparatus comprising a main assembly; an opening/closing member capable of opening and closing relative to said main assembly; an image forming portion accommodated in said main assembly and configured to form an image on a recording material; a fixing portion accommodated in said main assembly and fixing the image formed on the recording material, said fixing portion including a heat generation member configured to heat the recording material carrying the image, a nip forming member forming a nip configured to nip and feed the recording material, an electric energy supply connector for supplying electric energy to said heat generation member, and a shutter capable of opening and closing an entrance of said fixing portion which leads to said nip; and a link connecting said opening/closing member and said shutter with each other to move said shutter in interrelation with movement of said opening/closing member, wherein when said opening/closing member moves from a closed state to an open state, said link moves in a direction crossing with a surface of said nip to cause said shutter to move from a first position for opening said entrance to a second position for closing said entrance, and wherein in a state that said shutter is in the second position, substantially an entirety of said electric energy supply connector is covered by said link, as seen from an upstream side in a recording material feeding direction in the nip.

Further features of the present invention will become apparent from the following description of exemplary embodiments with reference to the attached drawings.

DESCRIPTION OF THE EMBODIMENTS

Hereinafter, the present invention is described with reference to a few of the preferred embodiments of the present invention, and appended drawings. Although the preferred embodiments are the best embodiments of the present invention, they are not intended to limit the present invention in scope. That is, the present invention is also applicable, within its scope, to various image forming apparatus which are different in structure from those in the following embodiments.

Embodiment 1

<Image Forming Apparatus 100>

Figure 1A:
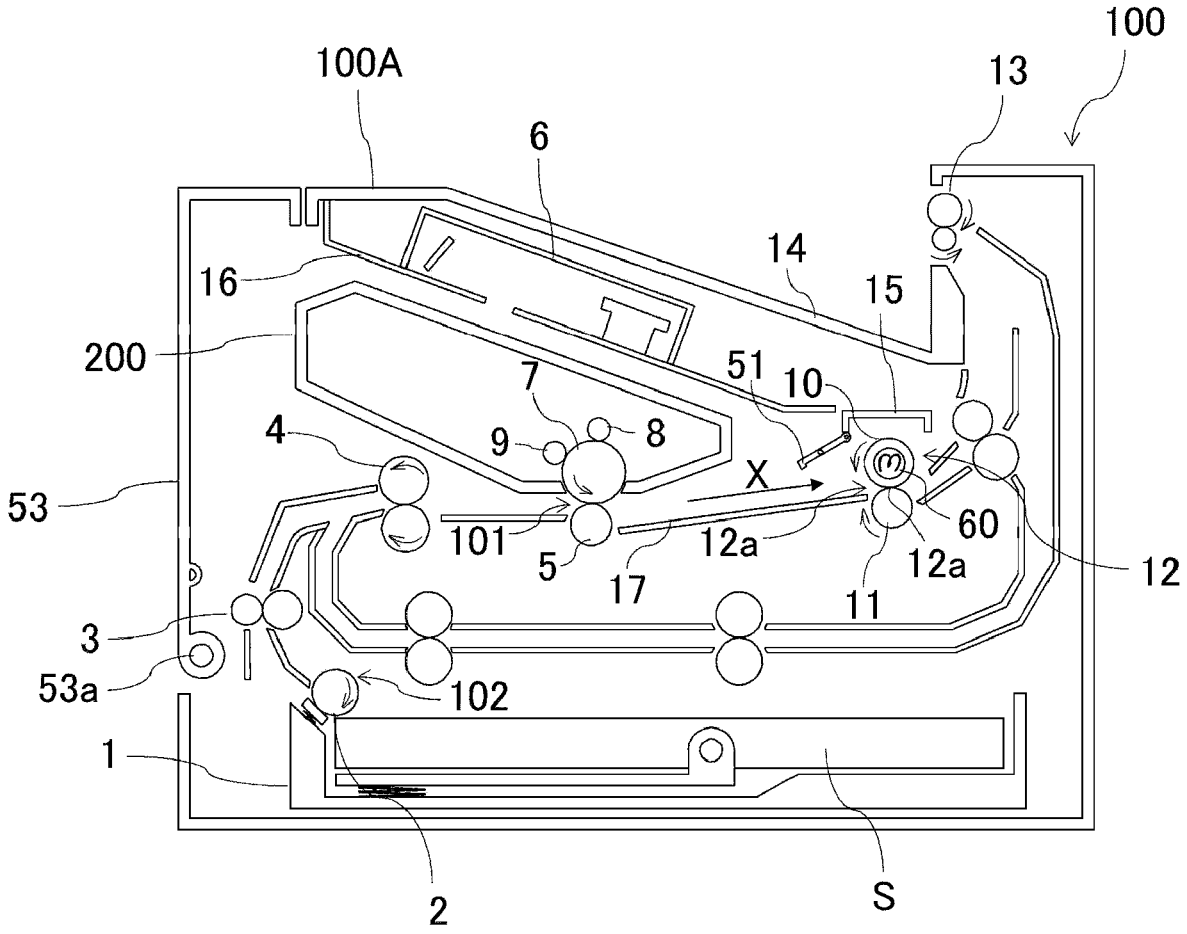
FIG. 1A is a sectional view of an image forming apparatus, and shows the general structure of the apparatus.

First, referring to FIG. 1A, the image forming apparatus 100 in this embodiment is described. FIG. 1A is a sectional view of an image forming apparatus (which in this embodiment is a monochromatic printer) based on electrophotographic technologies. It shows the general structure of the apparatus 100.

The image forming apparatus 100 has a main assembly 100A, which has: an image forming portion 101 which forms an image on a sheet S of recording medium; a feeding portion 102 which supplies the image forming portion 101 with the recording medium; and a fixing portion 12 which fixes an unfixed toner image on the recording medium to the recording medium.

The image forming portion 101 has: a cartridge 200 which is removably installable in the apparatus main assembly 100A; a transfer roller 5 (transferring member); and a laser scanner 6 (exposing portion). The cartridge 200 has a photosensitive drum 7 (image bearing member), a charging device 8, and a developing device 9. Since the operation of the image forming portion is well known, it is not described in detail here.

The fixing portion 12 (which will be referred to as fixing device, hereafter) has: a power supply connector 18 (power supplying portion (FIG. 3A)); and a halogen heater 60 (heat generating member) which generates heat as it is supplied with electric power through the connector 18. Further, the fixing device 12 has: a fixation roller 10 (fixing member) which internally holds a heater 60; and a pressure roller 11 (pressing member) which forms a nipping portion 12*a* in cooperation with the fixation roller 10. The fixation roller 10 and pressure roller 11 are nip forming members. The fixation roller 10 and pressure roller 11 are rotatably supported by the frame 15 of the fixing device 12, by their lengthwise end portions. The lengthwise end portions of the heater 60 are supported by the frame 15. The fixation roller 10 is heated by the radiant heat irradiated by the heater 60.

Sheets S of recording medium stored in a cassette 1 in the apparatus main assembly 100A are moved one by one out of the cassette 1 into the apparatus main assembly 100A. Then, each sheet S of recording medium is conveyed by the rotation of rollers 3 and 4 to a transferring portion formed by the drum 7 and roller 5. In the transferring portion, an unfixed toner image (unfixed image) is transferred onto the sheet S. Then, the sheet S on which the unfixed toner image is borne is conveyed to the nipping portion 12*a* of the fixing device 12, and conveyed through the nipping portion 12*a*, remaining pinched between the fixation roller 10 and pressure roller 11, and being heated. Consequently, the unfixed toner image becomes fixed to the sheet S. After the sheet S is conveyed out of the fixing device 12, it is discharged into the delivery tray 14 by the rotation of a roller 13.

<Apparatus Main Assembly 100A>

Figure 1B:
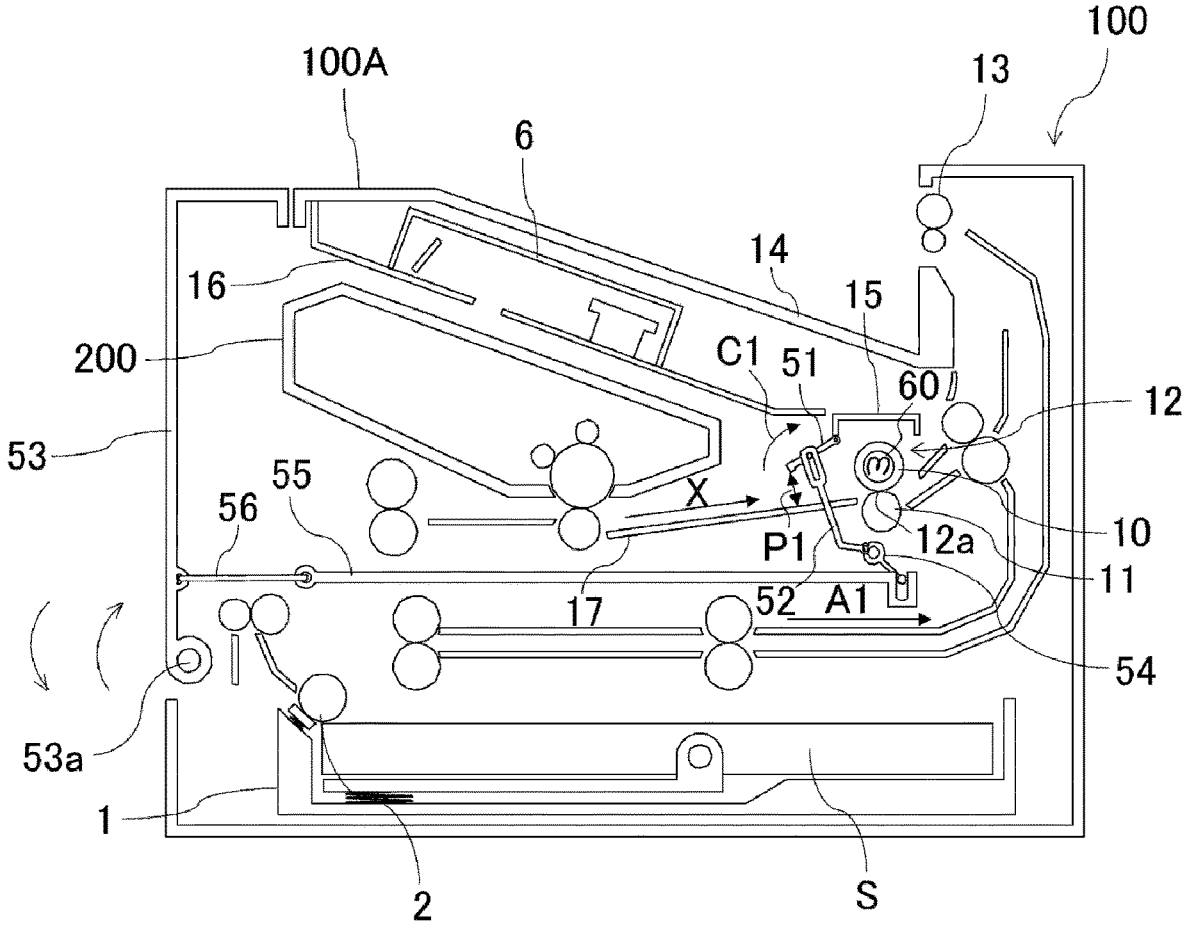
FIG. 1B is a sectional view of the image forming apparatus shown in FIG. 1A, which shows the structure of the apparatus when the pivotally movable cover of the apparatus is remaining closed.
Figure 1C:
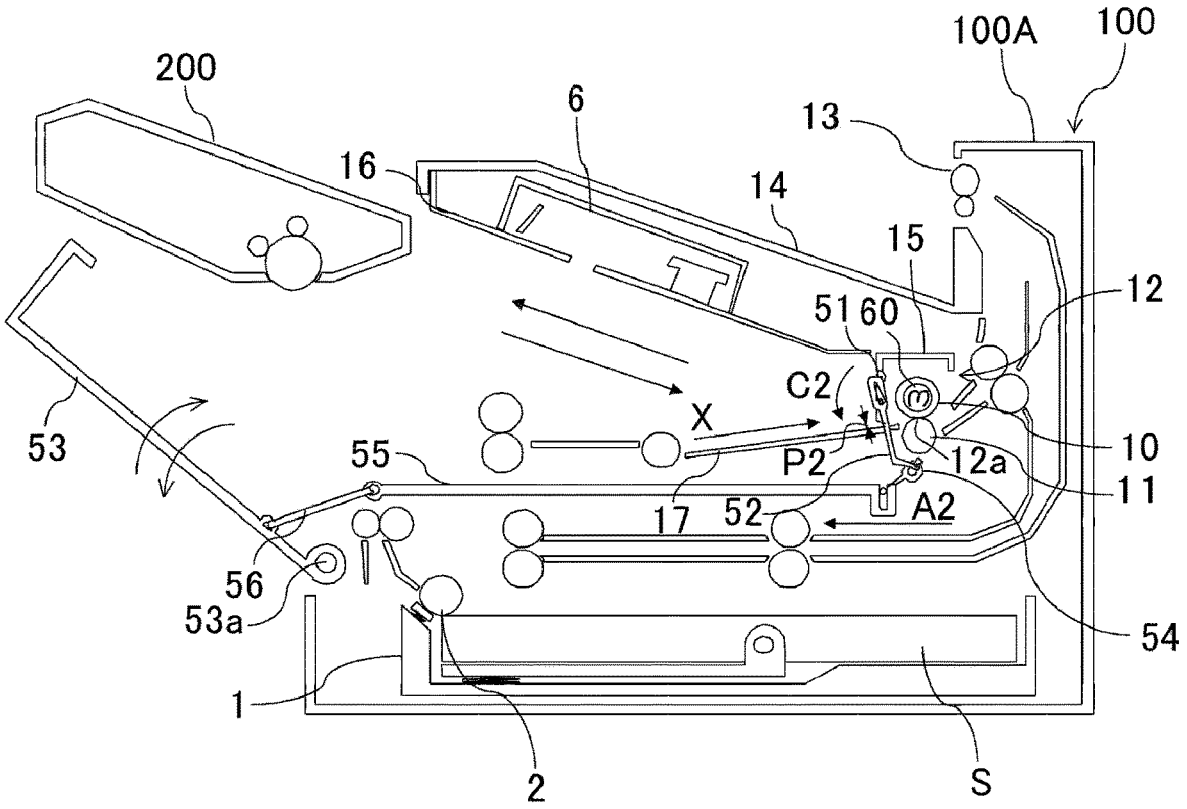
FIG. 1C is a sectional view of the image forming apparatus shown in FIG. 1A, which shows the structure of the apparatus when the pivotally movable cover of the apparatus is open.

Next, referring to FIGS. 1B and 1C, the apparatus main assembly 100A is described. FIG. 1B is a sectional view of the image forming apparatus 100 when the cover 53 of the apparatus 100 is remaining closed. It shows the general structure of the apparatus 100. FIG. 1C is a sectional view of the image forming apparatus 100 when the cover 53 is open. It also shows the general structure of the apparatus 100.

Referring to FIG. 1B, the apparatus main assembly 100A has: the cover 53 which can be opened to expose the interior of the apparatus main assembly 100A, and closed to cover the interior; and a shutter 51 which can block, or unblock, the upstream side of the nipping portion 12*a* in terms of the recording medium conveyance direction X. Further, the apparatus main assembly 100A has: a first linking member 52 which is in connection to the shutter 51; an interlocking member 54 which is in connection to the first linking member 52; and a second linking member 55 which is in connection to the interlocking member 54.

(Relationship Between Movement of Cover 53 and Movement of Shutter 51)

Referring to FIG. 1A, the cover 53 is a part of one of the peripheral members of the apparatus main assembly 100A. It is attached to the apparatus main assembly 100A with the placement of a supporting shaft 53*a* between the cover 53 and apparatus main assembly 100A. The cover 53 is pivotally movable about the shaft 53*a* to be opened or closed relative to the apparatus main assembly 100A. When it is necessary to remove the cartridge 200 from the apparatus main assembly 100A, or install the cartridge 200 into the apparatus main assembly 100A, the cover 53 can be opened or closed in the direction indicated by an arrow mark in FIG. 1C. When the cover 53 is open, not only is it possible to replace the cartridge 200, but also, to deal with paper jam and/or other maintenance issues.

When the cover 53 is open, the shutter 51 keeps blocked the upstream side of the nipping portion 12*a* of the fixing device 12, in terms of the direction X, to protect the nipping portion as shown in FIG. 1C (closes entry way into interior of fixing portion). On the other hand, when the cover 53 is remaining closed, it keeps unblocked the upstream side of the nipping portion 12*a* in terms of the direction X to allow a sheet S of recording medium to be conveyed into the nipping portion 12*a*.

(Structural Arrangement for Moving Cover 53, Second Linking Member 55, First Linking Member 52, and Shutter 51 Together)

Figure 3A:
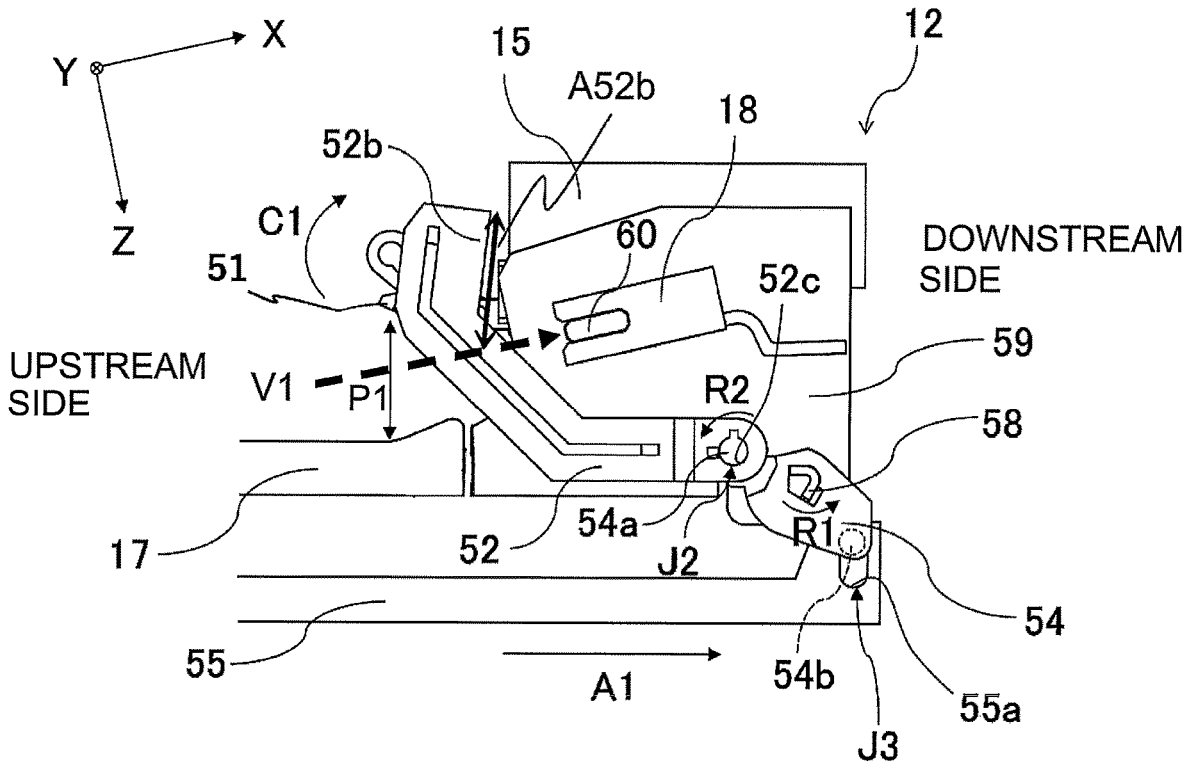
FIG. 3A is a side view of the connector-side lengthwise end portion of the fixing device in the first embodiment.
Figure 3B:
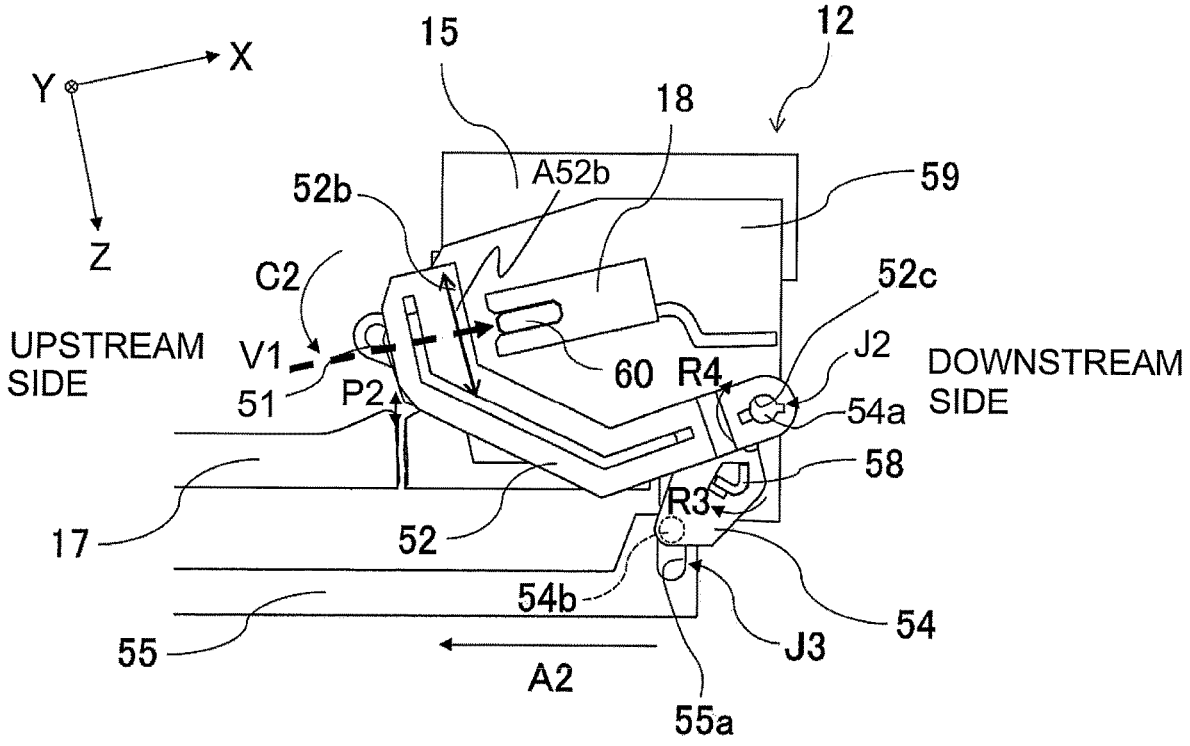
FIG. 3B is a side view of the connector-side lengthwise end portion of the fixing device in the first embodiment.

FIG. 3A is a side view of the lengthwise end portion of the fixing device 12, which has the connector 18, when the linking member 52 is in its first position (i.e., when shutter 51 is in its first position in which it keeps the entrance open). FIG. 3B is a side view of the lengthwise end portion of the fixing device 12, which has the connector 18, when the linking member 52 is in its second position (i.e., when shutter 51 is in its second position in which it keeps the entrance blocked).

Figure 3C:
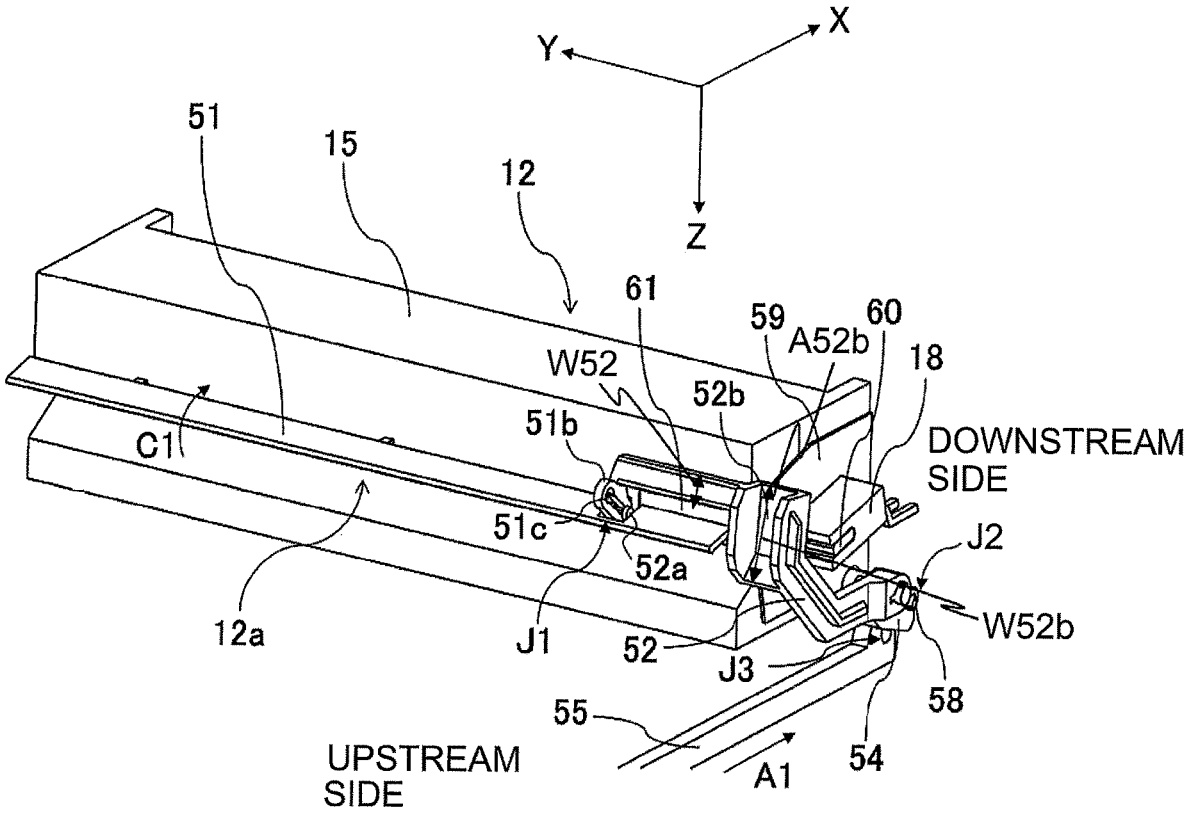
FIG. 3C is a perspective view of the fixing device in the first embodiment.
Figure 3D:
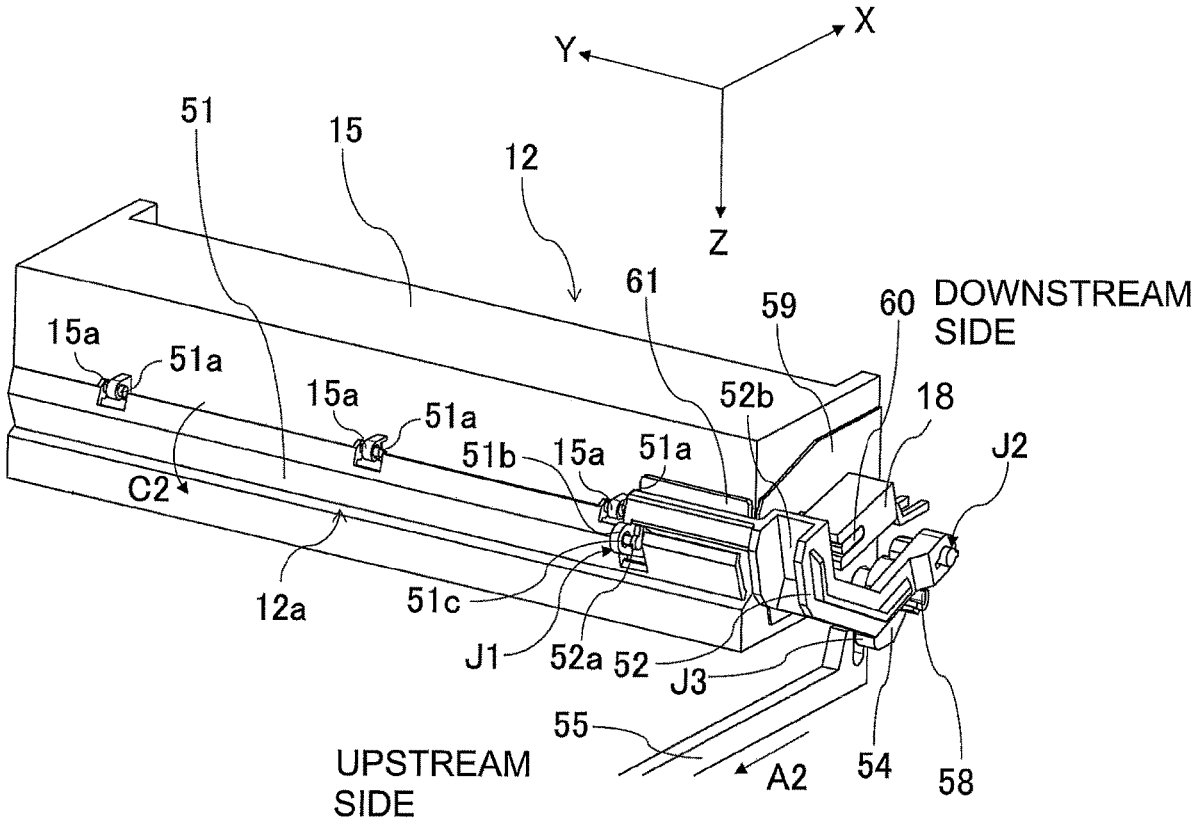
FIG. 3D is a perspective view of the fixing device in the first embodiment.

FIG. 3C is a perspective view of the fixing device 12 when the linking member 52 is in its first position. FIG. 3D is a perspective view of the fixing device 12 when the linking member 52 is in its second position.

The shutter 51 is supported by the frame 15 so that it can be opened or closed. Referring to FIG. 3D, the shutter 51 is provided with multiple supportive shafts 51*a*, which are in alignment with each other in terms of the direction Y which is perpendicular to the direction X. The supportive shafts 51*a* are rotatably supported by being inserted into the multiple supportive holes 15*a*, one for one, with which the frame 15 is provided. A referential code 59 stands for each of the side plates, in terms of the direction Y, with which the frame 15 is provided.

Referring to FIG. 3C, the upstream end of the linking member 52, in terms of the direction X, is in connection to the shutter 51 by a connective portion J1. The connective portion J1 comprises: a guide 51*b* which is a part of the shutter 51; an elongated hole 51*c*, with which this guide 51*b* is provided; and a shaft 52*a*, with which the upstream end portion of the linking member 52, in terms of the direction X, is provided. The elongated hole 51*c* extends diagonally upward relative to the direction X. The shaft 52*a* is put through this elongated hole 51*c*, being enabled to move in the lengthwise direction of the elongated hole 51*c*. By the way, a referential code 54 stands for a substrate which is in electrical connection to a temperature sensor for detecting the temperature of the fixation roller 10.

Referring to FIG. 3A, the downstream end portion of the linking member 52, in terms of the direction X, is in connection to the interlocking member 54 by way of the connective portion J2. In terms of the direction Y, which is perpendicular to the direction X, the interlocking member 54 is rotatably supported by the shaft 58 with which the frame 15 is provided. In terms of the direction Y, connective portion J2 comprises: a hole 52*c* with which the linking member 52 is provided; and a shaft 54*a* with which the interlocking member 54 is provided. Through the hole 52*c*, the shaft 54*a* is rotatably put.

Referring to FIG. 3A, the interlocking member 54 and the downstream end portion of the linking member 55, in terms of the direction X, are in connection to each other through a connective portion J3, which comprises the shaft 54*b* with which the interlocking member 54 is provided, and a groove 55*a* with which the linking member 55 is provided, in terms of the direction Y. The groove 55*a* extends in the direction which is perpendicular to the moving direction A1 of the linking member 55. Through this groove 55*a*, the shaft 54*b* is rotatably put.

(Coordinative Movement of Cover 53, Second Linking Member 55, and First Linking Member 52)

Referring to FIG. 1B, the linking member 55 is in connection to the cover 53 through a pressure release link 56. As the cover 53 is pivotally moved from the position in which it is when the image forming apparatus 100 is in the state shown in FIG. 1A, to the position in which it is when the image forming apparatus 100 is in the state shown in FIG. 1C, the linking member 55 moves in the direction indicated by an arrow mark A2 in FIG. 1C. Here, the position, in which the linking member 52 is after its movement into a position in which it presses the shutter 51 downward, is referred to as the second position of the linking member 52. The linking member 52 moves in the direction which is perpendicular to the surface of the nipping portion 12*a* (roughly in direction Z in this embodiment).

On the contrary, as the cover 53 is closed to change the image forming apparatus 100 in state from the one shown in FIG. 1C to the one shown in FIG. 1B, the linking member 55 is moved in the direction indicated by an arrow mark A1. Thus, the linking member 52 is moved, by the movement of the linking member 55, into the position in which it causes the shutter 51 to move upward. This position of the linking member 52 will be referred to as the first position of the linking member 52.

That is, when the cover 53 is remaining closed, the linking member 52 is in its first position, whereas when the cover 53 is remaining open, the linking member 52 is in its second position.

(Opening Movement of Shutter 51)

Referring to FIGS. 3A and 3C, as the linking member 55 moves in the direction indicated by the arrow mark A1 in such a manner that the state of the image forming apparatus 100 changes from the one shown in FIG. 3B to the one shown in FIG. 3A or 3C, the linking member 55 causes the connective portion J3 to move in the same direction. As the connective portion J3 moves in the direction indicated by the arrow mark A1, the interlocking portion 54 rotates in the direction indicated by an arrow mark R1 about a supporting shaft 58, as shown in FIG. 3A. This rotational movement of the interlocking member 54 causes the connective portion J2 to rotate upstream in terms of the direction X, moving (displacing) the linking member 52 into its first position. Further, the shaft 52*a* of the connective portion J1 moves upstream in terms of the direction X along the elongated hole 51*b*, moving thereby shutter 51 upward.

Therefore, the shutter 51, which is in the state shown in FIG. 3B, pivotally moves (opens) in the direction indicated by an arrow mark C1 about the supporting shaft 51*a*, unblocking thereby the upstream side of the nipping portion 12*a* in terms of the direction X. Referring to FIG. 1B, the distance P1 (height P1) of the entrance of the recording medium conveyance passage formed between a conveyance guide 17 and shutter 51 has to be large enough to allow a sheet S of recording medium to smoothly advance into the fixing device 12. In this embodiment, the distance P1 is set to roughly 10 mm. As the upstream side of the recording medium conveyance passage to the nipping portion 12*a* is unblocked, it becomes possible for the sheet S to be conveyed to the nipping portion 12*a*.

(Blocking Movement of Shutter 51)

Referring to FIGS. 3B and 3D, as the linking member 55 which is in the state shown in FIG. 3A moves in the direction indicated by an arrow mark A2 in such a manner that it changes in state from the one shown in FIG. 3A to the one shown in FIGS. 3B and 3D, the linking member 55 causes the connective member J3 to move in the same direction. As the connective portion J3 moves in the direction indicated by the arrow mark A2, the interlocking member 54 pivotally moves in the direction indicated by the arrow mark R3 about the supporting shaft 58 as shown in FIG. 3B. This pivotal movement of the interlocking member 54 causes the connective portion J2 to rotate downstream in terms of the direction X, causing thereby the linking member 52 to move (displace) into the second position. Further, the shaft 52*a* of the connective portion J1 pushes down the shutter 51 while moving downstream in terms of the direction X, within the elongated hole 51*b* of the shutter 51.

Thus, the shutter 51 pivotally moves (closes) in the direction indicated by the arrow mark C2 about the supporting shaft 51*a*, blocking thereby the upstream side of the nipping portion 12*a* in terms of the direction X. Referring to FIG. 1C, in this embodiment, the fixing device 12 is structured so that the height P2 of the entrance to the nipping portion 12*a*, which is formed by the conveyance guide 17 and shutter 51, is roughly 2 mm. The reason why the entrance to the nipping portion 12*a* is not completely blocked so that the height P2 becomes 0 mm is to minimize the amount of damage to which a sheet S of recording medium might sustain in the nipping portion 12*a* when the shutter 51 covers the roller 10.

(Structural Arrangement for Protecting Connector 1 (Power Supplying Portion) of Comparative Fixing Device 12)

Figure 2A:
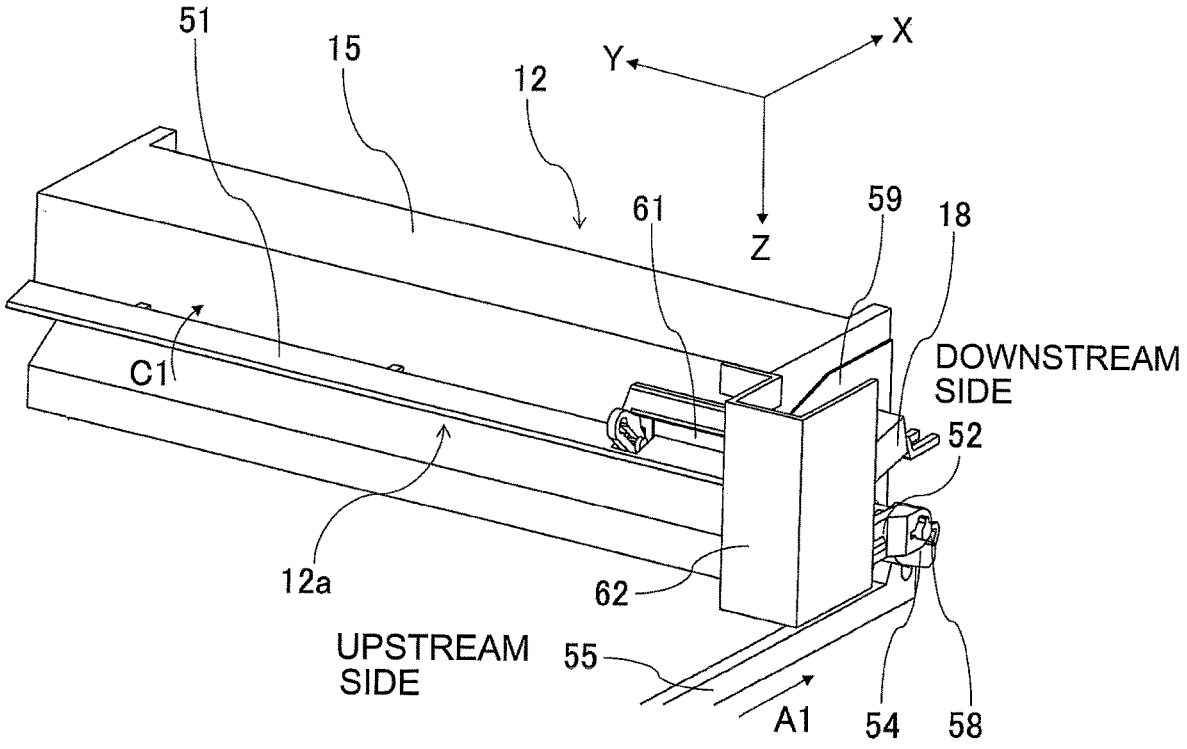
FIG. 2A is a perspective view of an example of a comparative (conventional) fixing device.
Figure 2B:
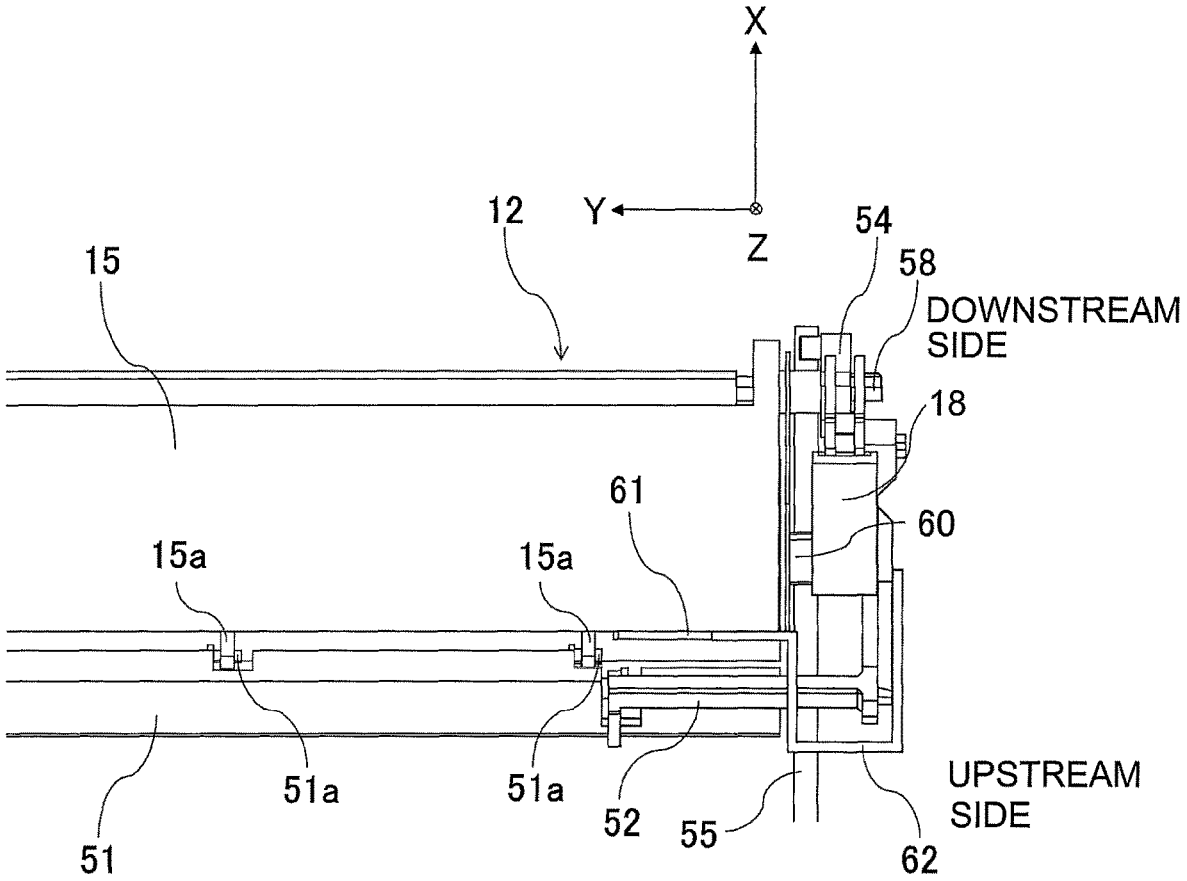
FIG. 2B is a side view of the lengthwise end portion of the comparative fixing device, in terms of the lengthwise direction, which is on the connector side.

FIG. 2A is a perspective view of a comparative fixing device 12 which has a shielding member 62 for covering the connector 18. FIG. 2B is a top view of the lengthwise end portion of the fixing device 12, as seen from the thickness direction of the recording medium, that is, the direction Z.

Referring to FIGS. 2A and 2B, the fixing device 12 is provided with a shielding member 62 for protecting the connector 18. The shielding member 62 is immovably attached to the frame 15 of the fixing device 12. The shielding member 62 needs to be positioned to protect the connector 18. Further, it has to be positioned so that when the first linking member 52 is pivotally moved, it will be outside the path of the linking member 52. Therefore, the shielding member 62 is positioned on the upstream side of the linking member 52 in terms of the direction X, as shown in FIG. 2B. It is large enough to shield (cover) the entirety of the connector 18.

Figure 2C:
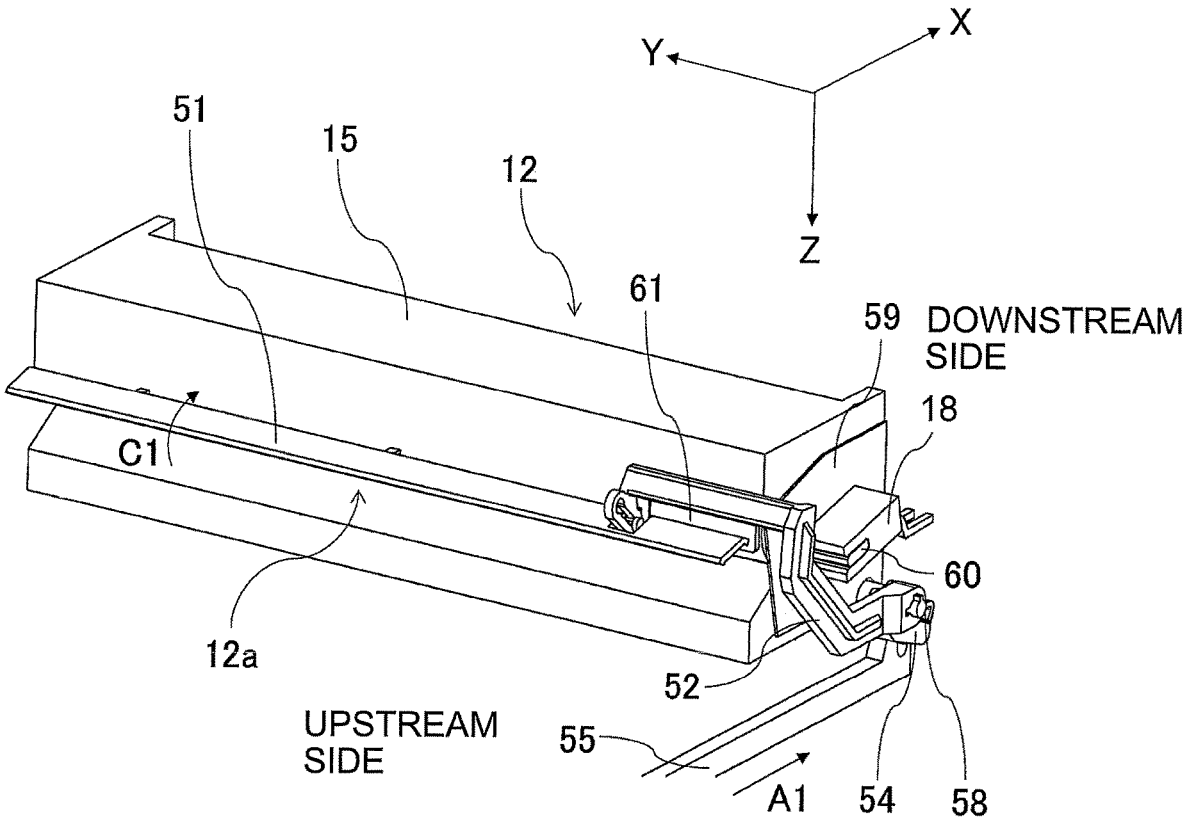
FIG. 2C is a perspective view of the comparative fixing device.
Figure 2D:
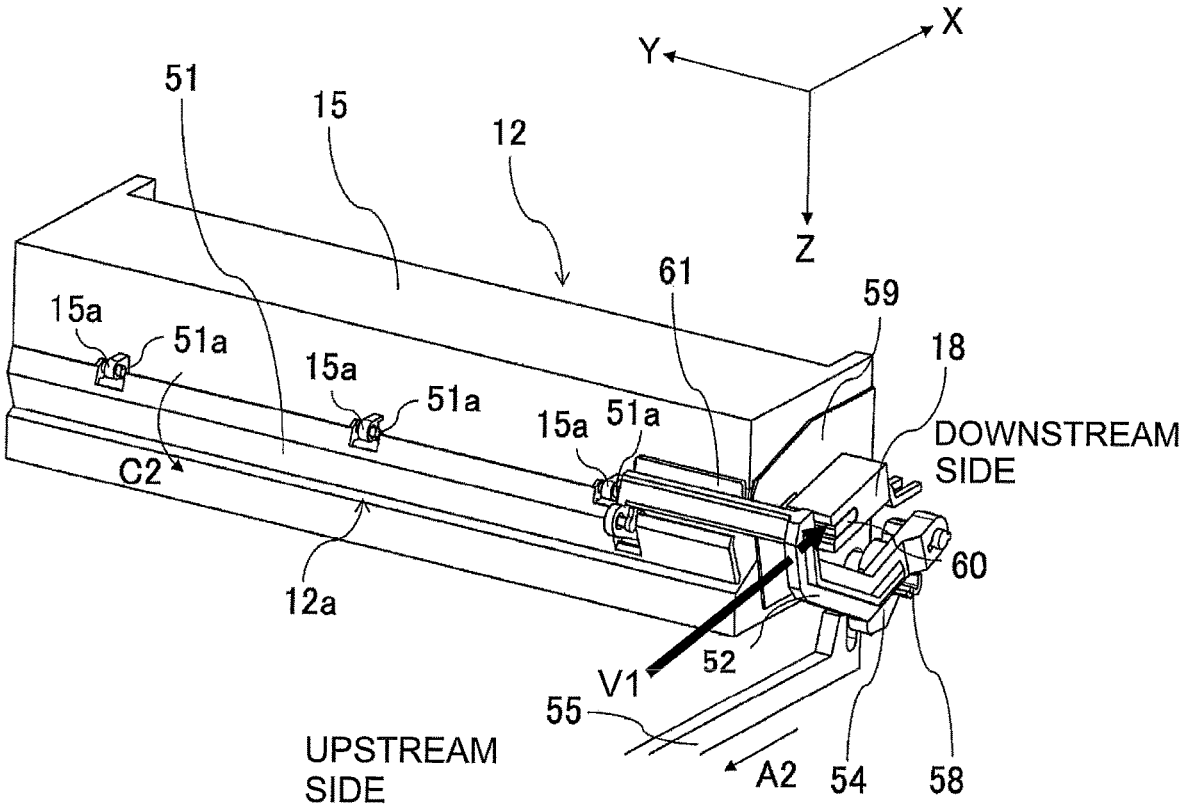
FIG. 2D is a perspective view of the comparative fixing device.

FIGS. 2C and 2D are perspective views of the comparative fixing device 12, from which the shielding member 62 has been removed. FIG. 2C is a perspective view of the comparative fixing device 12 when the shutter 51 is open, and therefore, the upstream side of the nipping portion 12*a* in terms of the direction X is remaining unblocked. FIG. 2D is a perspective view of the comparative fixing device 12 when the shutter 51 is remaining closed, and therefore, the nipping portion 12*a* is remaining blocked on the upstream side in terms of the direction X.

If the shielding member 62 is not present, roughly the entirety of the connector 18 is visible when the upstream side of the nipping portion 12*a* in terms of the direction X is remaining covered by the shutter 51 as shown in FIG. 2D, as seen from the direction indicated by arrow mark V1 (i.e., direction X, in which sheet S of recording medium is conveyed in nipping portion 12*a*). That is, rough the entirety of the upstream side of the connector 18 remains unprotected.

Therefore, in order to make it possible to continuously protect the connector 18, without significantly increasing the apparatus 100 in cost and size, it is necessary to structure the image forming apparatus 100 so that the connector 18 is protected by a member which can replace the shielding member 61, which is fixed in position.

(Structural Arrangement, in this Embodiment, for Protecting Connector 18 (Power Supplying Portion of Fixing Device 12))

Referring to FIGS. 3B and 3D, the fixing device 12 in this embodiment is structured so that as the connector 18 is seen from the side where the cover 53 is (as seen from direction indicated by arrow mark V1) when the linking member 52 is in its second position, the area A52*b* of the wall portion 52*b*, with which the linking member 52 is provided, hides roughly the entirety of the connector 18 of the fixing device 12. Therefore, the linking member 52 plays the role of the shielding member 62 of comparative fixing device 12, and the connector 18 is protected by the wall portion 52*b* of the linking member 52. By the way, a width W52*b* of the wall portion 52*b* in terms of the direction (Z) perpendicular to the surface of the nipping portion 12*a* is wider than the width W52 of the portion of the linking member 52, which is on the shutter 51 side.

While a cover 53 is open, and therefore, a user is allowed to access the interior of the apparatus main assembly 100A, it is necessary to protect the connector 18. Therefore, the fixing device 12 is structured so that as the fixing device 12 is seen from the direction V1 when the linking member 52 is in its first position (FIGS. 3A and 3C), the wall portion 52*b* does not hide the entirety of the connector 18 (partially exposed), but when the linking member 52 is in its second position, the wall portion 52*b* hides roughly the entirety of the connector 18 (partially exposed). By the way, the fixing device 12 may be structured so that the wall portion 52*b* hides the entire area of the connector 18 as seen from the direction V1, not only when the linking member 52 is in the second position, but also, when in the first position.

Figure 3E:
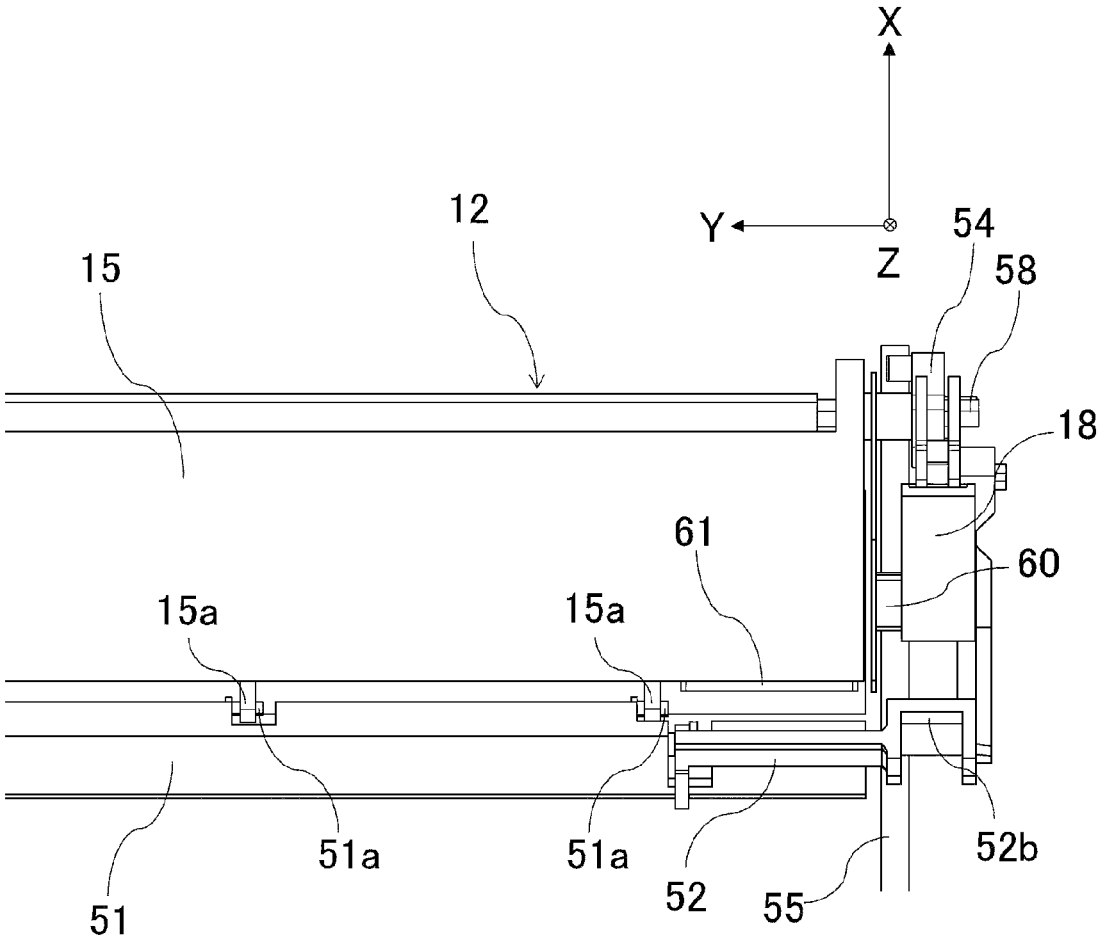
FIG. 3E is a connector-side lengthwise end portion of the fixing device in the first embodiment.

FIG. 3E is a perspective view of the lengthwise end portion of the fixing device 12, which has the connector 18, as seen from the thickness direction of a sheet S of recording medium, that is, in the direction Z.

As it can be understood through the comparison between FIG. 3E, and FIG. 2B which shows the comparative example of fixing device 12, the elimination of the shielding member 62 which is in the comparative fixing device 12 makes it possible to reduce the fixing device 12 in size by the amount equal to the space required for the shielding member 62. Therefore, not only is the fixing device 12 in this embodiment more effective in terms of special efficiency, but also, it makes it possible to reduce the apparatus main assembly 100A in size by the amount by which the fixing device 12 can be reduced in size by the elimination of the shielding member 62.

As described above, the image forming apparatus 100 in this embodiment is structured so that as it is seen from the direction V1, the connector 18 is hidden by the wall portion 52*b* with which the linking member 52 is provided. More specifically, it is structured so that as the shutter 51 is opened, the wall portion 52*b* of the linking member 52 is moved by the movement of the shutter 51, into the position in which the wall portion 52*b* covers the connector 18. That is, the present invention can provide a fixing device 12 which is virtually no higher in cost and size than any conventional fixing device, and yet, can protect the connector 18 just as well as any conventional fixing device.

Embodiment 2

Next, the present invention is described with reference to another example of image forming apparatus 100 which is in accordance with present invention. This embodiment is described regarding only the structural features of the fixing device 12, which are different from those in the first embodiment.

Figure 4A:
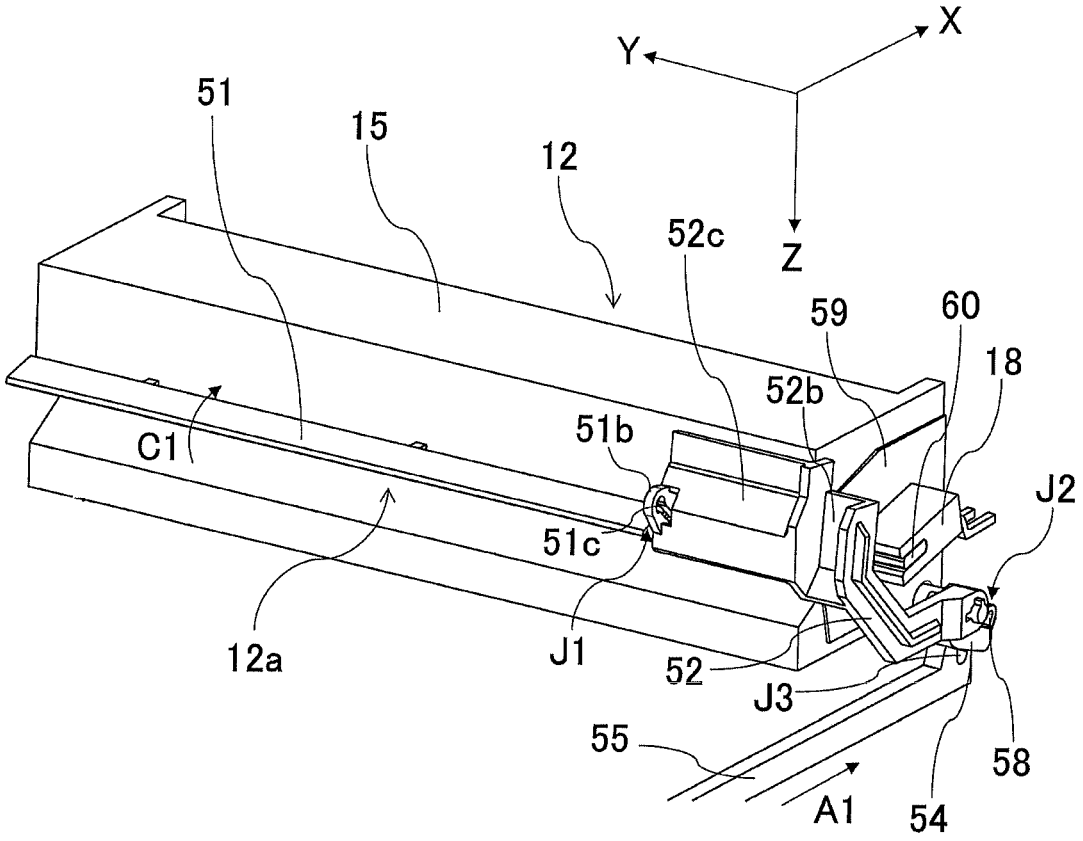
FIG. 4A is a perspective view of the fixing device in the second embodiment of the present invention.
Figure 4B:
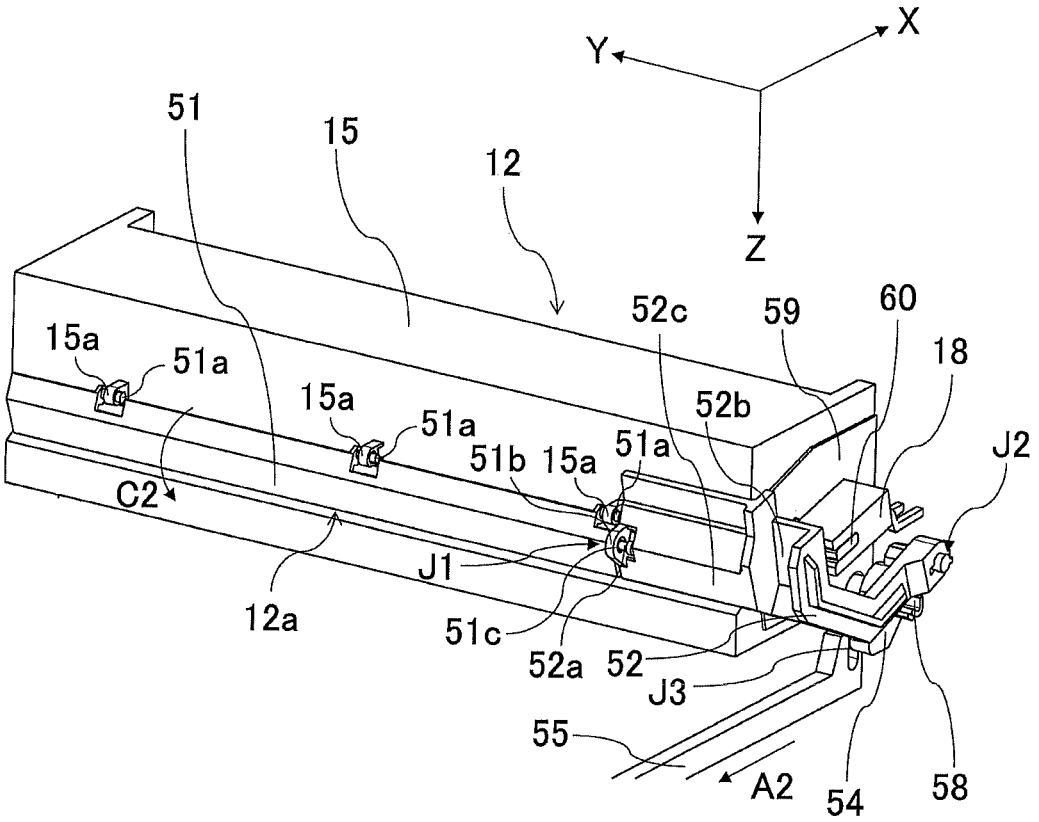
FIG. 4B is a perspective view of the fixing device in the second embodiment.

FIG. 4A is a perspective view of the fixing device 12 when the linking member 52 is in its first position. FIG. 4B is a perspective view of the fixing device 12 when the linking member 52 is in its second position.

Referring to FIGS. 4A and 4B, the linking member 52 of the fixing device 12 has a wall portion 52*c*, in addition to the wall portion 52*b* for covering the connector 18. This wall portion 52*c* is for covering (hiding) the end portion of the nipping portion 12*a* in terms of the direction perpendicular to the recording medium conveyance direction X. That is, it is for protecting the end portion of the nipping portion 12*a*.

Referring to FIG. 4A, when the fixing device 12 is such a state that the shutter 51 does not cover nipping portion 12*a*, the wall portion 52*c* does not cover the end portion of the nipping portion 12*a*. Referring to FIG. 4B, when the first linking member 52 is in its second position, that is, when the fixing device 12 is in such a state that the shutter 51 is covering the nipping portion 12*a*, the wall portion 52*c* covers the end portion of the nipping portion 12*a*.

In the first embodiment, the shutter 51 covered the entire range of the entrance of the nipping portion 12*a* in terms of the direction Y which is perpendicular to the recording medium conveyance direction X. However, if a substrate 16 to which a temperature sensor, etc., are connected is disposed in the adjacencies of the end portion of the nipping portion 12*a* as shown in FIGS. 3C and 3D, the shaft 51*a* for supporting the shutter 51, and hole 15*a* of the frame 15, through which the shaft 51*a* is put, cannot be placed in the adjacencies of the end portion of the nipping portion 12*a*. Therefore, the shutter 51 has to be cantilevered in such a manner that it is supported by the opposite end of the frame from the one having the sensor substrate. Therefore, the fixing device 12 in this embodiment is inferior to the fixing device 12 in the first embodiment, in terms of the coverage of the sensor substrate side of the nipping portion 12*a* by the shutter 51.

In this embodiment, therefore, the linking member 52, which is supported by both of its lengthwise end portions, is provided with the wall portion 52*c* for covering the end portion of the nipping portion 12*a*. Therefore, the fixing device 12 in this embodiment is superior to the fixing device in the first embodiment in terms of the coverage of the sensor substrate side of the nipping portion 12*a* by the shutter 51.

Figure 4C:
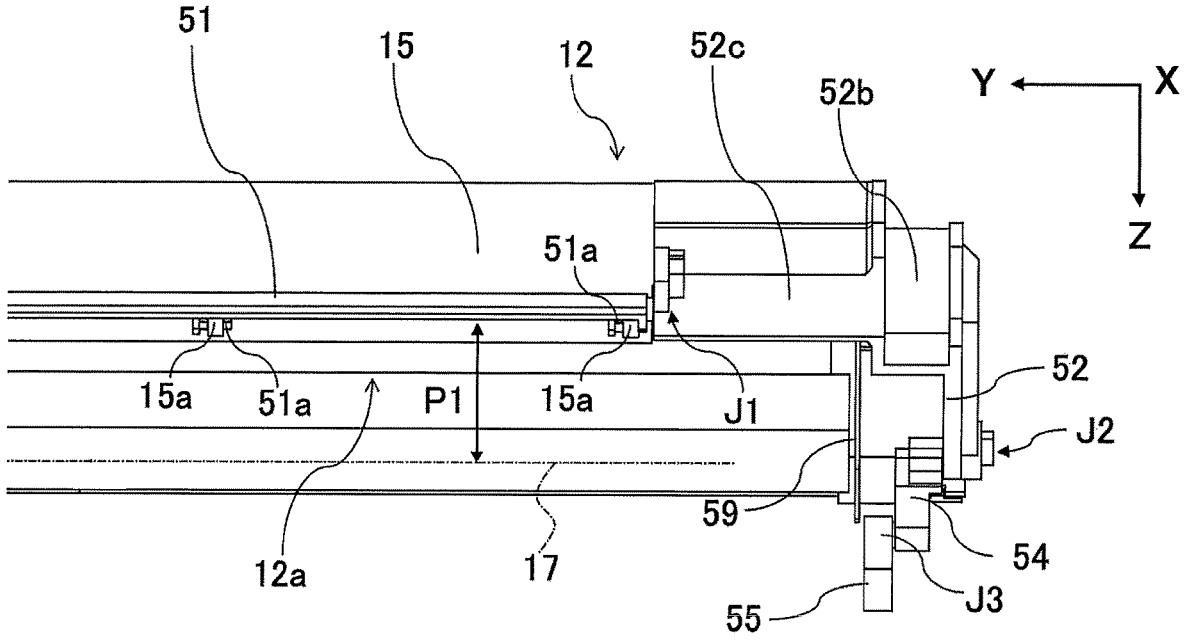
FIG. 4C is a side view of the connector-side lengthwise end portion of the fixing device in the second embodiment.
Figure 4D:
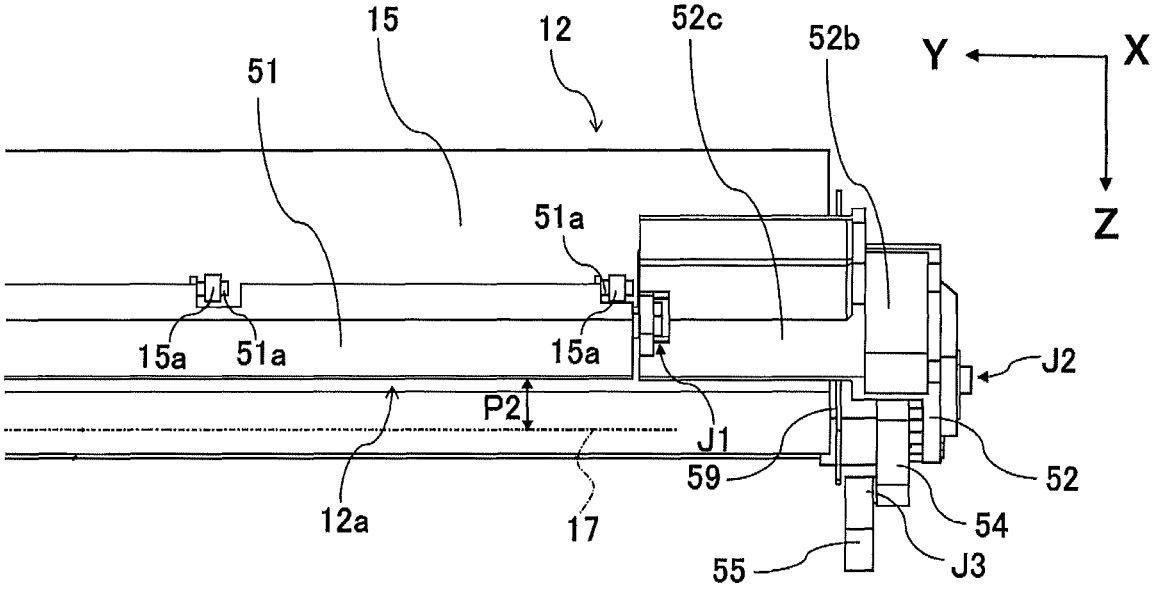
FIG. 4D is a side view of the connector-side lengthwise end portion of the fixing device in the second embodiment.

FIG. 4C is a side view of the connector 18 side end portion of the fixing device 12 shown in FIG. 4A, as seen from the upstream side of the direction X. When the shutter 51 is not covering the nipping portion 12*a*, the wall portion 52*c* of the nipping portion 12*a* is exposing the nipping portion 12*a* up to a height equal to the height P1 of the opening, like the shutter 51. On the other hand, when the shutter 51 is covering the nipping portion 12*a* as shown in FIG. 4D, the wall portion 52*c* of the linking member 52 is covering the nip portion 12*a* up to a height equal to the height P2 of the opening, like the shutter 51.

As described above, the image forming apparatus 100 in this embodiment covers the connector 18 by the wall portion 52*b*, with which the linking member 52 is provided. Therefore, this embodiment is just as effective as the first embodiment. In addition, the image forming apparatus 100 in this embodiment covers the end portion of the nipping portion 12*a* by the wall portion 52*c* of the linking member 52. Therefore, it is superior to the first embodiment in terms of the connector coverage by the shutter 51.

Embodiment 3

Next, the image forming apparatus 100 in another embodiment of the present invention is described. This embodiment is described regarding only its structural features which are different from the counter parts of the fixing device 12 in the second embodiment.

Figure 5A:
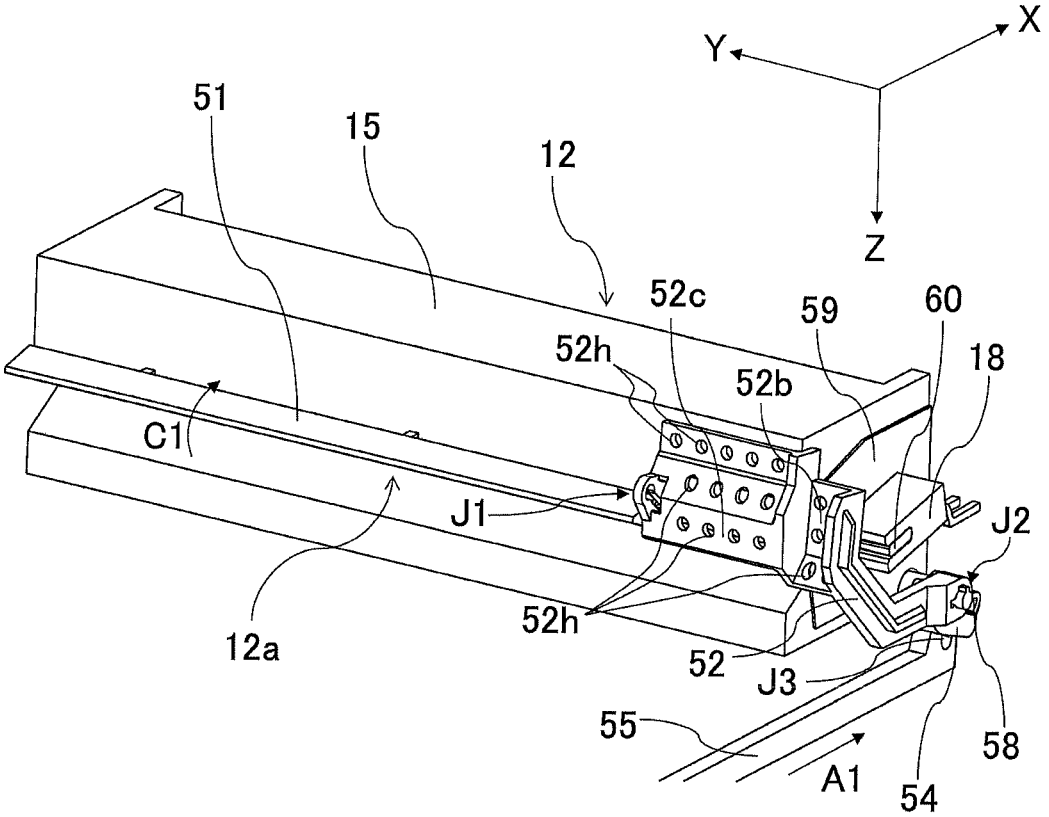
FIG. 5A is a perspective view of the fixing device in the third embodiment of the present invention.
Figure 5B:
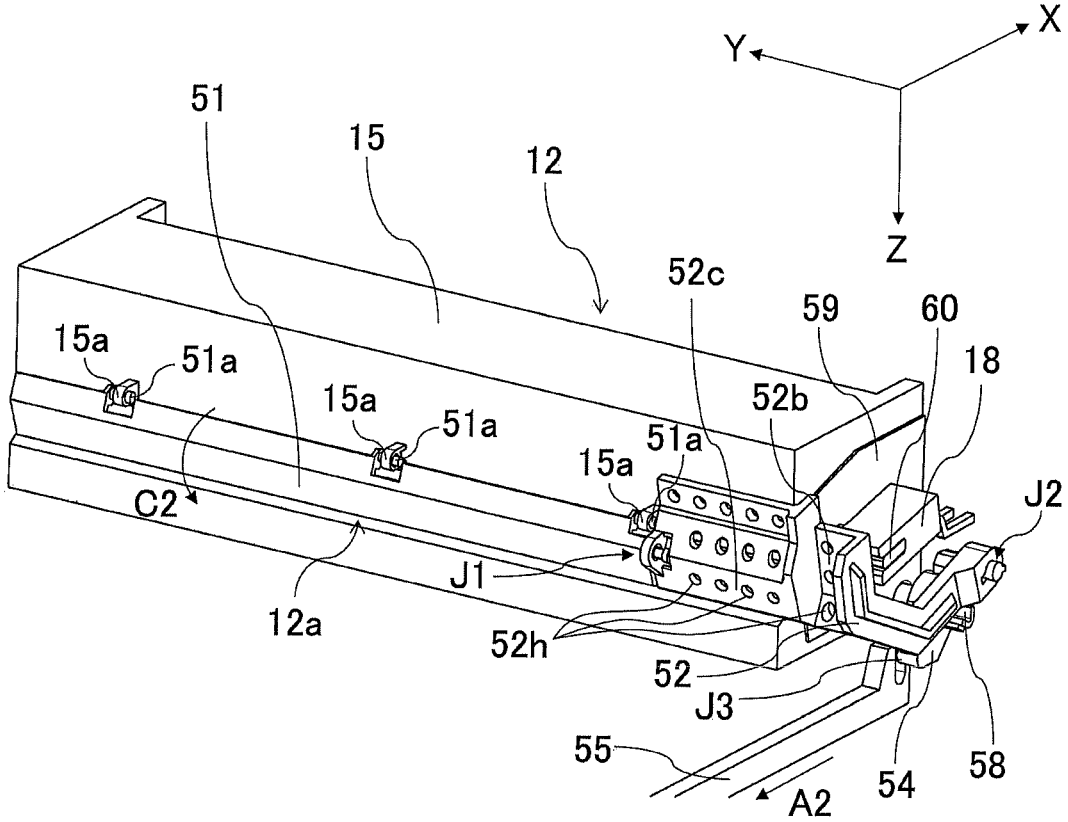
FIG. 5B is a perspective view of the fixing device in the third embodiment of the present invention.

FIG. 5A is a perspective view of the fixing device 12 when the linking member 52 is in its first position. FIG. 5B is a perspective view of the fixing device 12 as seen from the upstream side of the recording medium conveyance direction X when the linking member 52 is in its second position.

FIGS. 5A and 5B show the wall portion 52*b* of linking member 52, which is for covering the connector 18, and the wall portion 52*c* of the linking member 52, which is for covering the end portion of the nipping portion 12*a*, are provided with multiple through holes 52*h*, for the following reason. That is, when the linking member 52 is in the second position, and its wall portions 52*b* and 52*c* are covering the connector 18 and the end portion of the nipping portion 12*a*, respectively, the through holes 52*h* function as air passages for ventilating the adjacencies of the connector 18 and the end portion of the nipping portion 12*a*.

In the second embodiment, the wall portion 52*b* of the linking member 52, which is for covering the connector 18, and the wall portion 52*c* of the linking member 52, which is for covering the end portion of the nipping portion 12*a*, are not provided with the through holes. Therefore, when the linking member 52 is in the second position, it is difficult to provide the fixing device 12 with air passages to the connector 18 and the end of the nipping portion 12*a*.

In this embodiment, therefore, in order to provide the fixing device 12 with the air passages to the connector 18 and the end of the nipping portion 12*a*, without reducing the fixing device 12 in the ability to protect the connector 18 and the end portion of the nipping portion 12*a*, the wall portions 52*b* and 52*c* are provided with multiple through holes 52*h* as ventilation holes. In this embodiment, the through holes 52*h* are 4 mm in diameter.

Figure 5C:
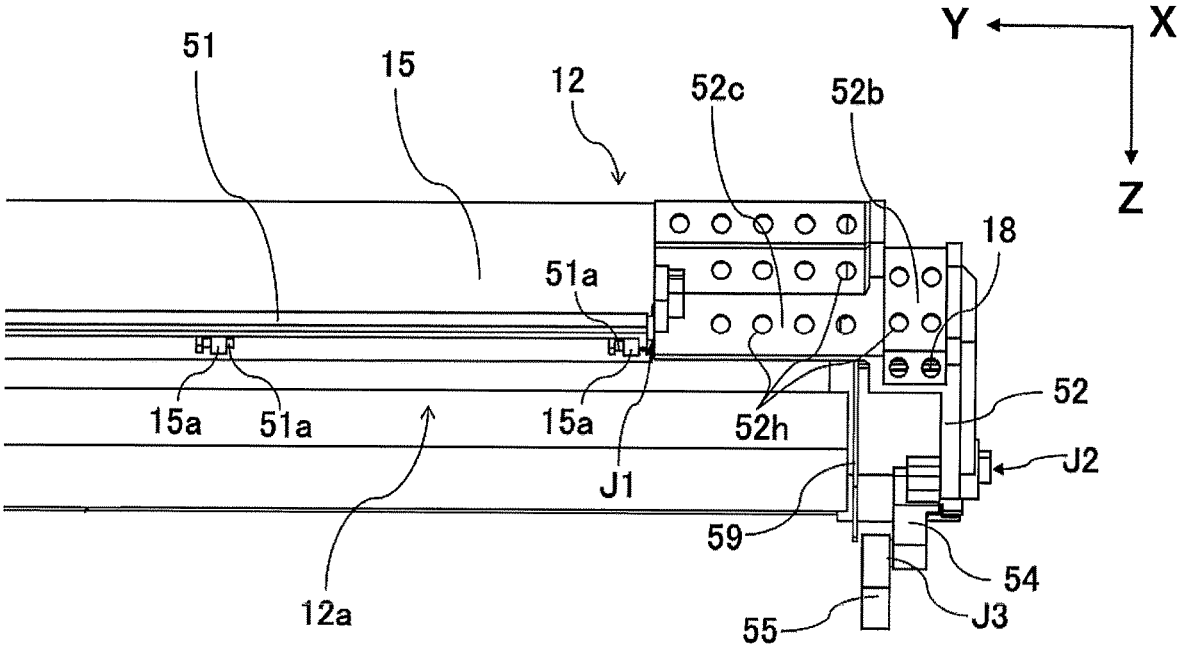
FIG. 5C is a side view of the connector-side lengthwise end portion of the fixing device in the third embodiment.
Figure 5D:
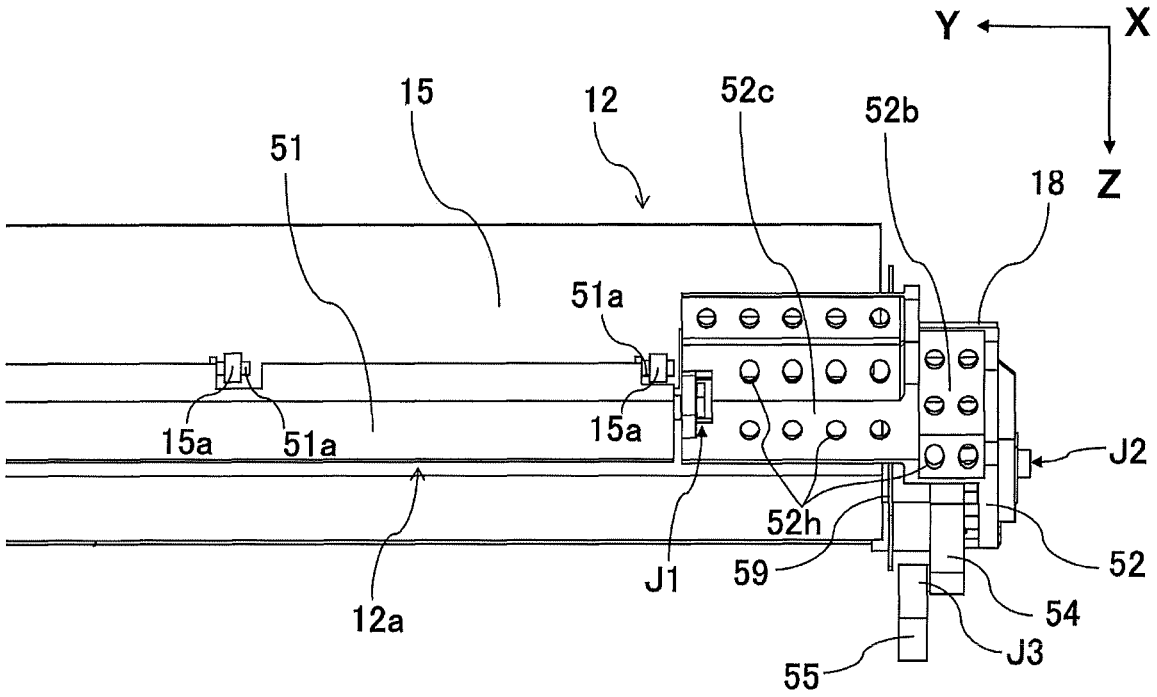
FIG. 5D is a connector-side lengthwise end portion of the fixing device in the third embodiment.

FIG. 5C is a side view of the connector 18 side end portion of the fixing device 12 as seen from the upstream side of the fixing device 12 in terms of the recording medium conveyance direction X when the fixing device 12 is in the state shown in FIG. 5A. FIG. 5D is a side view of the connector 18 side end portion of the fixing device 12 as seen from the upstream side of the fixing device 12 in terms of the recording medium conveyance direction X when the fixing device 12 is in the state shown in FIG. 5B.

Referring to FIGS. 5C and 5D, the wall portion 52*b* of the linking member 52, which is for covering the connector 18, and the wall portion 52*c* of the linking member 52, which is for covering the end portion of the nipping portion 12*a*, are provided with multiple through holes 52*h*. Therefore, not only are the connector 18 and the end portion of the nipping portion 12*a* well protected, but also, are provided with air passages as ventilation holes.

As described above, the image forming apparatus 100 in this embodiment is structured so that the connector 18 is protected by the wall portion 52*b* with which the linking member 52 is provided. Therefore, this embodiment is just as effective as the first embodiment. Moreover, the image forming apparatus 100 in this embodiment is structured so that the linking member 52 is supported by both of its lengthwise end portions, and the end portion of the nipping portion 12*a* is covered with the wall portion 52*c* of the linking member 52 which is supported at both of its lengthwise end portions. Therefore, it is just as effective as the second embodiment. Further, in this embodiment, the wall portion 52*b* of the linking member 52, which is for covering the connector 18, and the wall portion 52*c* of the linking member 52, which is for covering the end portion of the nipping portion 12*a*, are provided with multiple through holes. Therefore, it is possible to provide the image forming apparatus 100 with air passages to the connector 18 and the end portion of the nipping portion 12*a*, without reducing the apparatus 100 in the function to protect the connector 18 and the end portion of the nipping portion 12*a*.

Choices of the fixing device 12 to which the present invention is applicable are not limited to those which employ a heat roller. That is, the present invention is also applicable to fixing apparatuses of the so-call film heating type, which comprise: a heating plate (heating member) which generates heat as it is supplied with electric power from a power supplying portion 18; a cylindrical film (fixing member) which is to be heated by the heater; and a cylindrical roller or belt (pressing member) which forms a nip in cooperation with the film.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-047814 filed on Mar. 15, 2018, which is hereby incorporated by reference herein in its entirety.

What is claimed is:

1. An image forming apparatus comprising:

a main assembly;

an opening/closing member capable of opening and closing relative to said main assembly;

an image forming portion accommodated in said main assembly and configured to form an image on a recording material;

a fixing portion accommodated in said main assembly and configured to fix the image formed on the recording material, said fixing portion including a heat generation member configured to heat the recording material carrying the image, a nip forming member forming a nip configured to nip and feed the recording material, an electric energy supply connector for supplying electric energy to said heat generation member, and a shutter capable of opening and closing an entrance of said fixing portion which leads to said nip; and a link connecting said opening/closing member and said shutter with each other to move said shutter in interrelation with movement of said opening/closing member, wherein when said opening/closing member moves from a closed state to an open state, said link moves in a direction crossing with a surface of said nip to cause said shutter to move from a first position for opening said entrance to a second position for closing said entrance, wherein in a state that said shutter is in the second position, substantially an entirety of said electric energy supply connector is covered by said link, as viewed from an upstream side with respect to a recording material feeding direction in the nip.

2. The apparatus according to claim 1, wherein said shutter is provided at an upstream part of said fixing portion with respect to the recording material feeding direction, and said opening/closing member is provided on a part of said main assembly at a position away from said shutter toward an upstream side with respect to the recording material feeding direction.

3. The apparatus according to claim 1, wherein in a state that said shutter is in the first position, at least a part of said electric energy supply connector is uncovered by said link, as viewed from the upstream side with respect to the recording material feeding direction in the nip.

4. The apparatus according to claim 1, wherein a width, measured in a direction perpendicular to a surface of said nip, of a portion of said link is wider in a covering portion which covers said electric energy supply connector than in another portion of said link which is closer to said shutter than the covering portion.

5. The apparatus according to claim 1, wherein a part of said link functions as a part of said shutter.

6. The apparatus according to claim 1, wherein said link is provided with an air vent.

* * * * *